US008528699B2

(12) United States Patent
Eckersley

(10) Patent No.: US 8,528,699 B2
(45) Date of Patent: Sep. 10, 2013

(54) FORK-LIFT TRUCK

(75) Inventor: Paul John Eckersley, Basingstoke (GB)

(73) Assignee: Linde Material Handling GmbH, Aschaffenburg (DE)

( * ) Notice: Subject to any disclaimer, the term of this patent is extended or adjusted under 35 U.S.C. 154(b) by 1054 days.

(21) Appl. No.: 12/125,209

(22) Filed: May 22, 2008

(65) Prior Publication Data

US 2008/0302608 A1 Dec. 11, 2008

(30) Foreign Application Priority Data

May 29, 2007 (DE) ..... 10 2007 024 826
Oct. 15, 2007 (DE) ..... 10 2007 049 392

(51) Int. Cl.
*B66F 9/06* (2006.01)
*B66F 9/075* (2006.01)
*B66F 9/24* (2006.01)

(52) U.S. Cl.
USPC ..... 187/224; 187/222; 187/227; 414/631; 414/914; 296/65.17; 296/65.18; 180/326

(58) Field of Classification Search
USPC ..... 187/222, 224, 227; 414/631, 914, 414/629, 641, 642; 180/12, 291, 326, 333, 180/19.1, 19.3; 296/65.17, 65.18
IPC ..... B66F 9/075, 9/06
See application file for complete search history.

(56) References Cited

U.S. PATENT DOCUMENTS 3,486,333 A * 12/1969 Thomas ..... 60/394
3,827,532 A * 8/1974 Minich et al. ..... 280/756
4,919,233 A * 4/1990 Larsen et al. ..... 187/227
4,920,820 A * 5/1990 Ingham et al. ..... 74/491
5,044,472 A * 9/1991 Dammeyer et al. ..... 187/223
5,245,144 A * 9/1993 Stammen ..... 200/61.85
5,364,151 A * 11/1994 Yurasits ..... 296/65.09
5,746,291 A * 5/1998 Knauss et al. ..... 187/223
5,839,542 A * 11/1998 Seng et al. ..... 187/222
6,079,935 A * 6/2000 Brunner et al. ..... 414/641
6,089,353 A * 7/2000 Bartels et al. ..... 187/224
6,241,047 B1 * 6/2001 Gilliland et al. ..... 187/222
6,564,906 B1 * 5/2003 Haack et al. ..... 187/222
7,011,172 B2 * 3/2006 Heimbrock et al. ..... 180/65.51
2005/0023069 A1 * 2/2005 Lewis et al. ..... 180/321
2005/0023070 A1 * 2/2005 Smiley et al. ..... 180/321
2007/0207024 A1 * 9/2007 Kraimer et al. ..... 414/685

FOREIGN PATENT DOCUMENTS

DE 44 40 399 A1 5/1996
JP 08113495 A * 5/1996
JP 11240699 A * 9/1999
JP 11255491 A * 9/1999
JP 11255492 A * 9/1999
JP 2003012294 A * 1/2003

* cited by examiner

*Primary Examiner* — William A Rivera
*Assistant Examiner* — Stefan Kruer
(74) *Attorney, Agent, or Firm* — The Webb Law Firm

(57) ABSTRACT

A fork-lift truck has a battery-electric drive system, a driver's stand (10) having a driver's platform (11) for a standing operator formed between a load part (1) and a drive part (5) having a counterweight. The counterweight is formed by a battery pack device having at least one battery pack (9). The driver's stand (10) extends over the entire vehicle width. In this case, the drive part (5) has an equipment area (6), the battery pack device being arranged in a battery compartment (8), which is arranged above and/or adjacent to the equipment area (6), of the drive part (5).

19 Claims, 4 Drawing Sheets

FORK-LIFT TRUCK

CROSS-REFERENCE TO RELATED APPLICATIONS

This application claims priority to German Application DE 10 2007 024 826.3, filed May 29, 2007 and German Application DE 10 2007 049 392.6, filed Oct. 15, 2007, both of which applications are herein incorporated by reference in their entirety.

BACKGROUND OF THE INVENTION

1. Field of the Invention

The invention relates to a fork-lift truck having a battery-electric drive system, a driver's stand having a driver's platform for a standing operator being formed between a load part and a drive part having a counterweight.

2. Technical Considerations

A counterweight fork-lift truck in the form of a rider stacker with a driver's platform for a standing operator is known from DE 44 40 399 A1.

With the counterweight fork-lift truck known from DE 44 40 399 A1, the driver's stand for the standing operator is arranged between the load part and the drive part, when viewed in the longitudinal direction of the fork-lift truck. Laterally adjacent to the driver's stand formed by a driver's platform is arranged a battery pack, which is provided for supplying a battery-electric drive system of the fork-lift truck. In this case, the battery pack is arranged in a longitudinal direction of the fork-lift truck. The arrangement of the battery pack laterally adjacent to the driver's stand results in tight spatial conditions for the operator standing on the driver's platform. The lateral arrangement of the battery pack also leads to an unfavourable position for the centre of gravity of the counterweight fork-lift truck with a centre of gravity which is laterally offset with respect to the longitudinal axis.

The present invention is based on the object of providing a fork-lift truck of the generic type mentioned at the outset which is improved in terms of ergonomics for the operator and has a favourable position for the centre of gravity.

SUMMARY OF THE INVENTION

This object is achieved according to the invention by virtue of the fact that the counterweight is formed by a battery pack device having at least one battery pack, and the driver's stand extends over the entire vehicle width. In a counterweight fork-lift truck according to the invention in the form of a rider stacker, the battery pack device is arranged in the drive part and forms the counterweight. Owing to the arrangement of the battery pack device opposite the load part on the drive part and the use of the battery pack device as a counterweight, an improved and favourable position for the centre of gravity of the fork-lift truck according to the invention is achieved in a simple manner. This arrangement of the battery pack device on the drive part also makes it possible to design the driver's platform forming the driver's stand to cover the entire vehicle width. As a result, it is possible to achieve, in a simple manner, an increased amount of space available for the operator standing on the driver's platform. In addition, the operator can mount and dismount the driver's platform from both sides. Overall, improved ergonomics for an operator standing on the driver's platform in the case of a counterweight fork-lift truck according to the invention are therefore achieved.

In accordance with a preferred embodiment of the invention, the drive part has an equipment area, the battery pack device being arranged in a battery compartment, which is arranged above and/or adjacent to the equipment area, of the drive part. As a result, the battery pack device can be arranged in a simple manner in the drive part as a counterweight for achieving a favourable position for the centre of gravity of the fork-lift truck. If the battery compartment is arranged above the equipment area and, for example, extends over the entire vehicle width, an individual battery pack can be provided in a simple manner above the equipment area. If the equipment area has a centrally arranged traction drive unit and the battery compartment is formed on both sides laterally adjacent to the traction drive unit, in each case one battery pack can be arranged in a simple manner on both sides of the traction drive unit.

Particular advantages result if the battery compartment is arranged in the transverse direction of the fork-lift truck. The battery pack device arranged in the battery compartment is therefore arranged transversely with respect to the longitudinal axis of the fork-lift truck, as a result of which a position for the centre of gravity of the fork-lift truck which is symmetrical with respect to the longitudinal axis can be achieved with a centre of gravity arranged in the region of the longitudinal axis. The battery compartment and the battery pack device arranged therein can in this case extend only partially or completely over the vehicle width, depending on the desired and required capacity of the battery pack device.

In accordance with a preferred development of the invention, an operator's console, which comprises a steering wheel and a driving actuation device, is arranged on a region of the driver's stand which faces the load part. An operator's console arranged in such a way enables an operator standing on the driver's platform and viewing in the direction of the load part to have an operating position with favourable ergonomics and good viewing conditions of the load and the roadway.

Expediently, the load part has a lifting frame, the operator's console being arranged on a wall or parapet facing the lifting frame. With a parapet formed on the driver's stand, it is possible in a simple manner to form a boundary between the lifting frame, and therefore the load part, and the driver's stand, it being possible for the operator's console to be arranged on the parapet in a simple manner in an ergonomically favourable position.

The operator's console can be arranged fixedly. Particular advantages with respect to favourable ergonomics can be achieved if, according to an embodiment of the invention, the operator's console can be adjusted vertically and/or can be tilted. The operator's console having the steering wheel and the driving actuation device can hereby be adapted in a simple manner to the operator.

Particular advantages result if, in accordance with a preferred development of the invention, a further control device, which comprises at least one driving actuation device, is arranged in the region of the drive part. With such a control device arranged in the region of the drive part, at least one further operating position for an operator standing to the side on the driver's platform can be made possible in a simple manner, in which position ergonomically favourable operation of the fork-lift truck is achieved by means of the steering wheel arranged on the operator's console and the driving actuation device arranged on the control device. Such a lateral operating position is favourable particularly for driving of the fork-lift truck when the drive part is at the front in the direction of travel, for example in order to transport a picked-up load over long sections within a warehouse, since a good view of the roadway is made possible for the operator in this operating position.

In accordance with a preferred configuration of the invention, the driving actuation device has a handle and a driving switch arranged on the handle. The operator can secure himself by means of the handle in a simple manner when the fork-lift truck is travelling and, at the same time, actuate the drive switch with the fingers of the hand gripping the handle and therefore control the traction drive, as a result of which safe operation of the fork-lift truck is made possible.

With regard to favourable ergonomics for the operator, it is advantageous if an actuation device controlling a lifting drive, in particular at least one lifting and/or lowering switch, is arranged on the operator's console. The operator can therefore control the lifting drive for picking up or setting down the load in the operating position in which he is standing on the driver's platform and viewing in the direction of the load part, in an ergonomically favourable manner and with a good view of the load, by means of the actuating device arranged on the operator's console.

If at least one actuation device controlling an additional drive, in particular a momentary-contact switch, is arranged on the operator's console, a tilting drive of a load means or a pickup side-shifting device of the load pickup means can be actuated ergonomically in a simple manner.

Expediently, a signal transmitter, in particular a momentary-contact switch, for a signal device is arranged on the operator's console. With a signal transmitter, a warning device, which is in the form of, for example, a horn, can be actuated in a simple manner in the operating position in which the operator is standing on the driver's platform and viewing in the direction of the load part, the fork-lift truck being operated by the operator by means of the operator's console.

Expediently, an emergency-stop switch is furthermore arranged on the operator's console.

In accordance with a configuration of the invention, a display instrument is arranged on the operator's console. With such a display instrument, various operational parameters and operating states of the fork-lift truck can be displayed, for example the lifting height, the weight of the picked-up load or the state of charge of the battery pack. Owing to the arrangement of the display instrument on the operator's console, the operational parameters relating to load handling, for example the lifting height and the load weight, can be displayed in such a way that they can be perceived safely to the operator in the operating position in which the operator is standing on the driver's platform and is viewing in the direction of the load part and is actuating the lifting drive by means of the actuation device arranged on the operator's console.

In addition, a keyswitch can be arranged on the operator's console, with which keyswitch the fork-lift truck can be set in operation.

In accordance with a preferred configuration of the invention, the control device is arranged on a battery compartment cover covering the battery compartment. The control device comprising at least one driving actuation device can thereby be arranged in a simple manner in the region of the drive part in order to achieve, in an ergonomically favourable manner, at least one further operating position for an operator standing to the side on the driver's platform.

Particular advantages can be achieved if the battery compartment cover is arranged on the drive part such that it can pivot about a substantially horizontal pivot axis. A pivotable battery compartment cover makes it possible to gain access easily to the battery compartment.

If at least one signal transmitter, in particular a momentary-contact switch, for a signal device is arranged on the control device, in the further operating position, actuation of a signal device, for example in the form of a horn, is made possible for an operator standing to the side on the driver's platform with little constructional complexity.

With particular advantage, a leaning aid for an operator viewing in the direction of the load part is formed on the battery compartment cover. With such a leaning aid, the ergonomics for the operator in the operating position in which the operator is standing on the driver's platform and viewing in the direction of the load part can be improved in a simple manner.

In accordance with a preferred configuration of the invention, the leaning aid is formed by dents in the battery compartment cover. Such dents forming a leaning aid can be produced in a simple manner in the battery compartment cover. It is furthermore possible to attach a fold-away seat, for example a fold-away standing seat, or a back cushion to the battery compartment cover as a leaning aid.

Particular advantages result if at least one lateral leaning aid for an operator standing to the side is formed on the battery compartment cover. As a result, improved ergonomics for the operator can be achieved in the operating positions in which the operator is standing to the side on the driver's platform and the operation of the fork-lift truck takes place by means of the steering wheel arranged on the operator's console and driving actuation device arranged on the control device. In this case, the leaning aid likewise provides additional support for the operator in a simple manner when the fork-lift truck is travelling around a bend.

The leaning aid is in this case expediently formed by a laterally arranged extension of the battery compartment cover which extends in the direction of the driver's stand, as a result of which additional support for the operator can be achieved in a simple manner by means of the leaning aid when the fork-lift truck is travelling around a bend.

BRIEF DESCRIPTION OF THE DRAWINGS

Further advantages and details of the invention will be explained in more detail with reference to the exemplary embodiments illustrated in the schematic figures in which.

DESCRIPTION OF THE PREFERRED EMBODIMENTS

Figure 1:
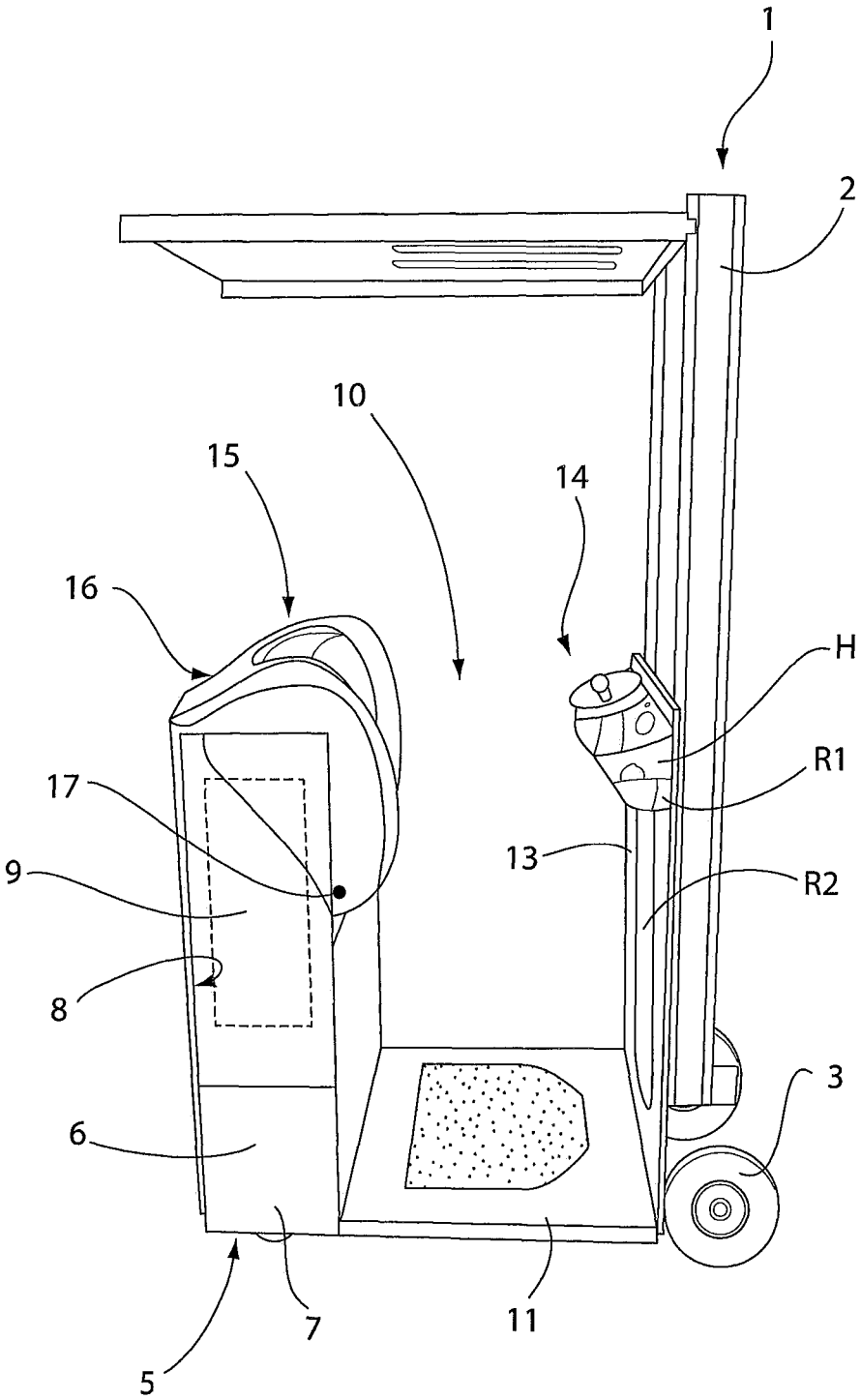
FIG. 1 shows a side view of a fork-lift truck according to the invention.

FIG. 1 illustrates a counterweight fork-lift truck in the form of a rider stacker according to the invention, which is provided with a battery-electric drive system. The fork-lift truck has a load part 1, which comprises a lifting frame 2, on which a load pickup means, for example a load fork, is arranged such that it can be moved up and down. In the region of the lifting frame 2, the fork-lift truck is provided with front wheels 3, which are near to the load and are in the form of running rollers.

The fork-lift truck has a drive part 5 opposite the load part 1, when viewed in the longitudinal direction of the fork-lift truck. The drive part 5 comprises an equipment area 6. A rear driving wheel 7, which is remote from the load, can be driven by means of a traction drive unit, for example an electrical traction motor, in a manner not illustrated in any more detail and can be steered by means of an electrical or hydraulic steering drive, is arranged in this equipment area 6. In addition, a working hydraulic unit, for example an electrical hydraulic assembly, for supplying a lifting drive, by means of which the load pickup arranged on the lifting frame 2 can be moved up and down, and for supplying any hydraulic additional drives which may be present can be arranged in the equipment area 6.

The drive part 5 furthermore forms a counterweight of the fork-lift truck. For this purpose, a battery compartment 8 is formed, according to the invention, above the equipment area 6, in which battery compartment 8 a battery pack device formed from, for example, a battery pack 9, which is denoted by the dashed lines in FIG. 1, is arranged. In this case, the battery compartment 8 is arranged in the transverse direction of the fork-lift truck and extends over the entire vehicle width, with the battery pack 9 arranged in the battery compartment 8 extending substantially over the entire vehicle width.

In the embodiment illustrated, the equipment area 6 is aligned horizontally and the battery compartment 8 having one battery pack or a plurality of battery packs is arranged above the equipment area 6. It is, however, likewise possible to align the equipment area 6 vertically, in particular centrally with respect to the longitudinal axis of the fork-lift truck, and to arrange the battery compartment 8 laterally adjacent to the equipment area 6 on one side or both sides, it being possible for one battery pack or a plurality of battery packs to be arranged on one side or both sides of the equipment area 6.

A driver's stand 10 for a standing operator is arranged between the load part 1, formed by the lifting frame 2, and the drive part 5, which is in the form of a counterweight and has the equipment area 6 and the battery compartment 8 for the battery pack 9, when viewed in the longitudinal direction of the fork-lift truck, which driver's stand 10 is formed by a driver's platform 11. In this case, the driver's platform 11 extends over the entire vehicle width.

Figure 2:
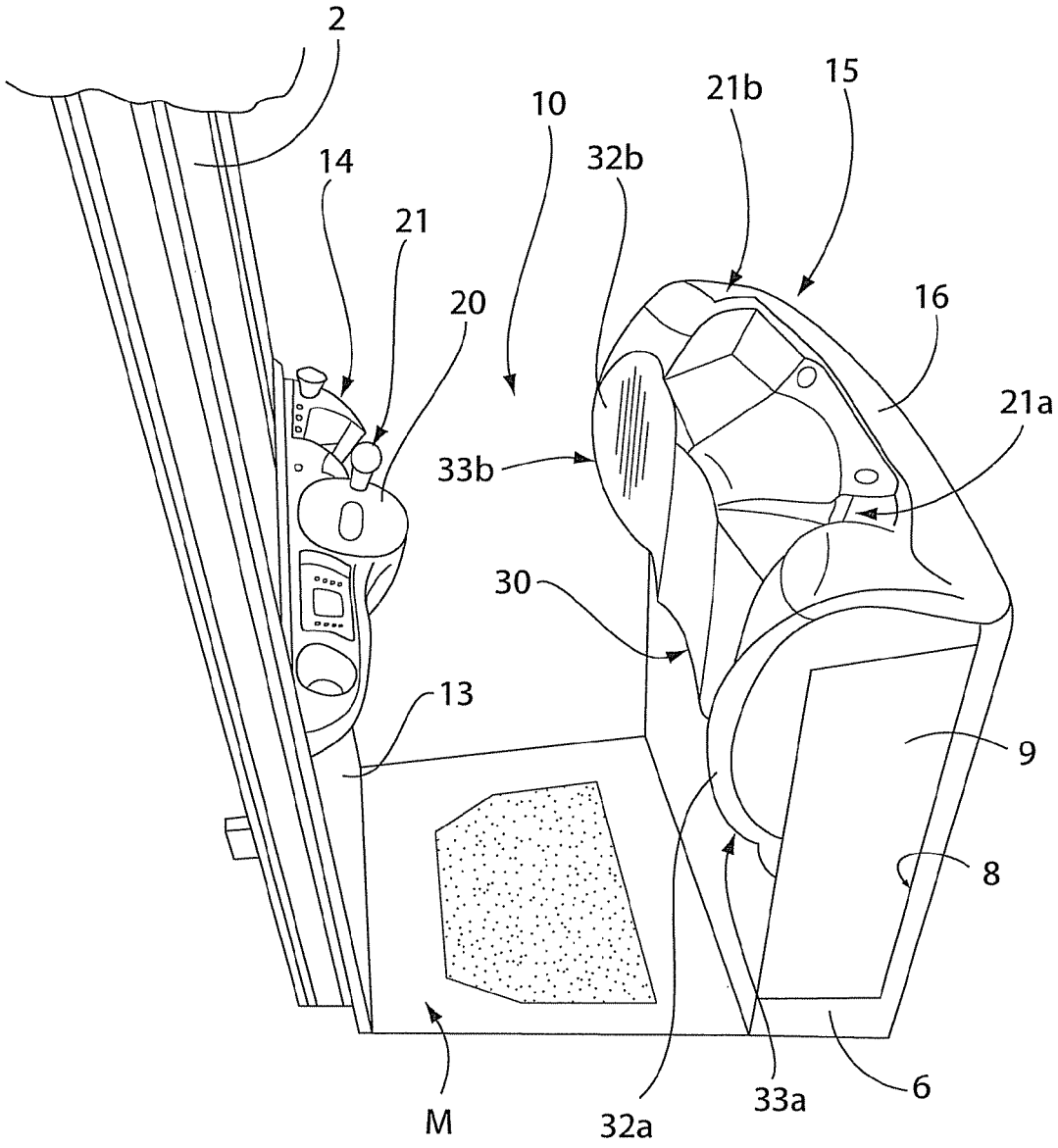
FIG. 2 shows an enlarged illustration of the driver's stand.

In a region facing the load part 1 and therefore the lifting frame 2, a wall or parapet 13, on which an operator's console 14 is arranged, is provided on the driver's stand 10, as can be seen in FIG. 2. The operator's console 14 can in this case be arranged on the parapet 13 fixedly or in such a way that it can be displaced in the vertical direction and/or in the horizontal direction and/or can be tilted. For example, the console 14 can be mounted on horizontal rails or runners R1 such that the console 14 is horizontally movable and/or can be mounted on one or more vertical rails or runners R2 such that the console 14 is vertically moveable. The console 14 can also be mounted by a hinge H such that the console can be tilted forwardly and backwardly around the hinge H to adjust the angle of the console 14.

A further control device 15 is provided in the region of the drive part 5. In this case, the control device 15 is arranged on a battery compartment cover 16 covering the battery compartment 8. The battery compartment cover 16 can in this case be arranged fixedly or, for example, such that it can pivot about a substantially horizontal pivot axis 17 in the direction of the load part 1.

Figure 3:
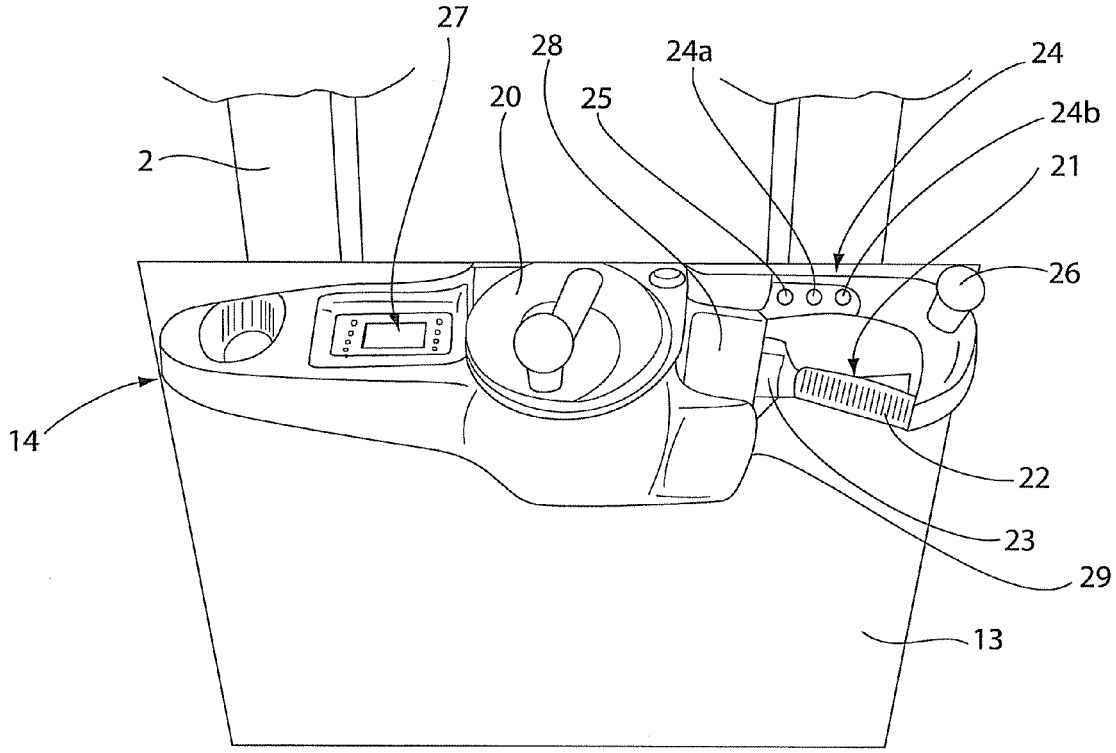
FIG. 3 shows an enlarged illustration of the operator's console.

The operator's console 14 arranged on the parapet 13 comprises, as is illustrated in FIG. 3, a steering wheel 20, which is arranged substantially centrally with respect to the longitudinal axis of the fork-lift truck, and a driving actuation device 21, which is arranged, for example, in the right-hand region of the operator's console 14. The driving actuation device 21 in this case has a handle 22 for the operator and a drive switch 23 arranged on the handle 22, it being possible for the traction motor driving the driving wheel 7 to be controlled in both movement directions of the fork-lift truck when said drive switch 23 is actuated. In this case, the drive switch 23 is in the form of a winged switch, for example. In addition, at least one actuation device 24 for an additional drive, for example a tilting drive of a load pickup means or a side-shifting device of the load pickup means is arranged on the operator's console 14. The actuation device 24 is formed, for example, by corresponding momentary-contact switches 24*a*, 24*b*. The operator's console 14 is furthermore provided with an actuation device 28 for a lifting drive, which actuation device is formed, for example, by a lifting and/or lowering switch, which is arranged, for example, laterally adjacent to the drive switch 23. In addition, a signal transmitter 25, for example a momentary-contact switch, for a signal device in the form of a horn is arranged on the operator's console 14. The drive switch 23, the actuation device 28 for the lifting drive, the actuation device 24 for the additional drive and the signal transmitter 25 for the signal device are in this case arranged on the operator's console 14 in such a way that they can be actuated by the operator with the fingers of the hand engaging around the handle 22. Furthermore, an emergency-stop switch 26 is arranged on the operator's console 14. In addition, a display instrument 27 is arranged on the operator's console 14, for example in the left-hand region of the operator's console 14. The operator's console 14 can furthermore be provided with a keyswitch 29, which is arranged, for example, underneath the driving actuation 21.

Figure 4:
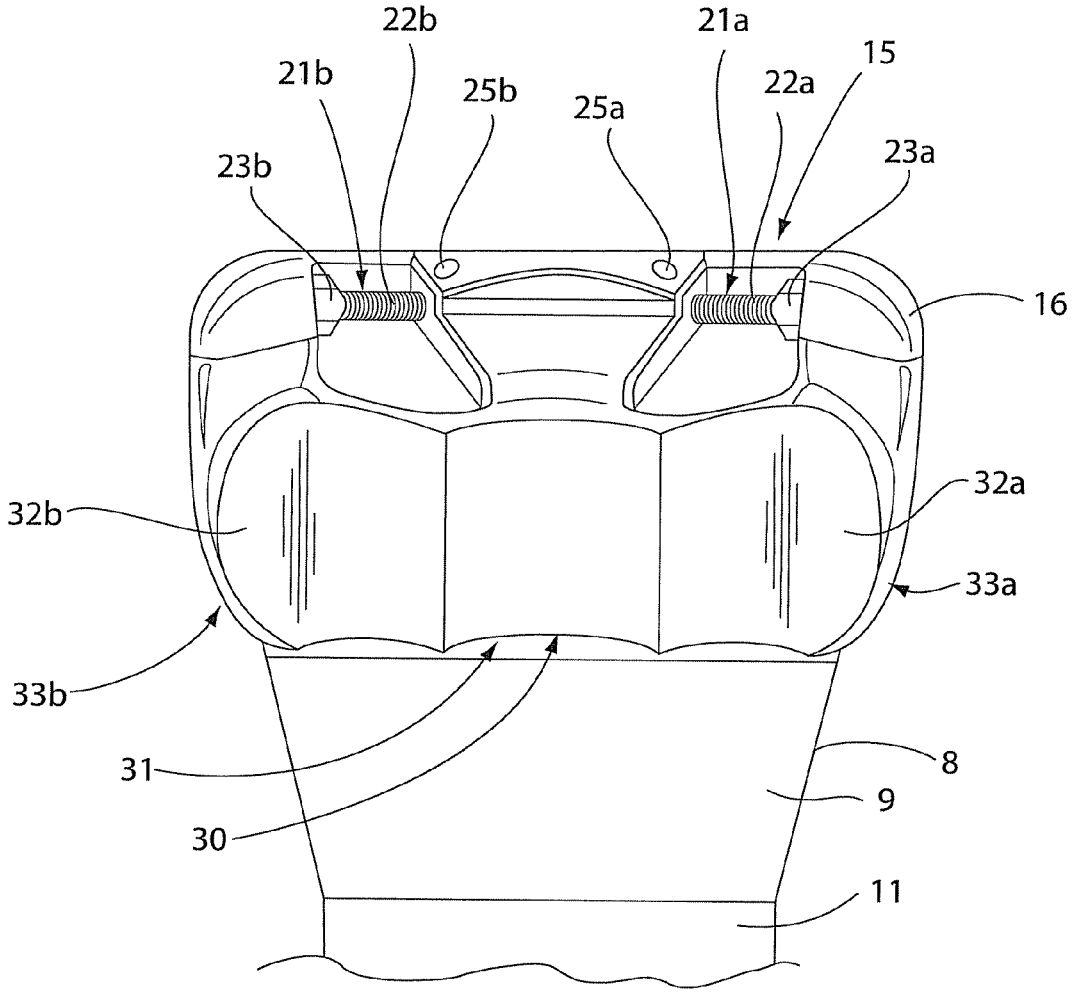
FIG. 4 shows an enlarged illustration of a control device.

FIG. 4 illustrates the control device 15, which is arranged on the battery compartment cover 16 covering the battery compartment 8. The control device 15 comprises driving actuation devices 21*a*, 21*b*, the driving actuation device 21*a* being arranged in the right-hand region of the control device 15, and the driving actuation device 21*b* being arranged in the left-hand region of the control device 15. The driving actuation devices 21*a*, 21*b* each have a handle 22*a*, 22*b* for the operator with a drive switch 23*a*, 23*b*, which is arranged on the handle 22*a*, 22*b* and is in the form of a winged switch, for example, it being possible for the traction motor driving the driving wheel to perform control in both movement directions of the fork-lift truck when the drive switch 23*a*, 23*b* is actuated. In addition, in each case one signal transmitter 25*a*, 25*b* in the form of a momentary-contact switch, for example, for a signal device, for example a horn, is arranged on the control device 15.

In the central region, the battery compartment cover 16 is provided with curved dents 30, which point in the direction of the driver's stand 10 and form a leaning aid 31 for an operator viewing in the direction of the load part 1. In the lateral region, the battery compartment cover 16 is provided with in each case one curved extension 32*a*, 32*b*, which extends in the direction of the driver's stand 10 and in each case forms a leaning aid 33*a*, 33*b* for an operator standing to the side. The leaning aids 31, 33*a*, 33*b* in this case preferably have such a vertical extent that leaning aids from the 5th percentile woman to the 95th percentile man (for example, in accordance with DIN EN ISO 33402) are made possible.

The fork-lift truck according to the invention has, owing to the battery pack 9, which is used as a counterweight and, according to the embodiment illustrated in the figures, is arranged on the drive part 5 over the equipment area 6 transversely with respect to the longitudinal axis of the fork-lift truck, has a centre of gravity which is in the region of the longitudinal axis of the fork-lift truck and therefore a favourable position for the centre of gravity, as a result of which favourable driving properties of the fork-lift truck are provided.

The driver's platform 11 extends over the entire vehicle width and makes it possible for the operator to mount and dismount on both sides of the fork-lift truck. In a first operating position, in which the operator is standing on the driver's platform 11 and is viewing in the direction of the load part 1, by means of the operator's console 14 arranged on the parapet 13 the operator can actuate the steering wheel 20 with his left hand and grip the handle 22 of the driving actuation device 21 with his right hand, it also being possible for the drive switch 23, the actuation device 24 for the lifting drive and the signal transmitter 25 to be operated in an ergonomically favourable manner using the fingers of the right hand. The centrally arranged dents 30 in the battery compartment cover 16 form a leaning aid 31 for the operator in this operating position. As a result, an ergonomically favourable operating position for the operator with a good view of the load can be achieved for the purpose of picking up and setting down the load.

With the control device 15 arranged in the battery compartment cover 16, in addition further operating positions for an operator standing to the side on the driver's platform 11 can be achieved in a simple manner. In a first, lateral operating position, the operator can actuate the steering wheel 20 arranged on the operator's console 14 with his right hand, it being possible for him to grip the handle 22*a* of the driving actuation device 21*a* arranged on the battery compartment cover 16 with his left hand and to actuate the drive switch 23*a* with the fingers of his left hand, which is gripping the handle 22*a*. In this first, lateral operating position, the extension 32*b* forms a lateral leaning aid 33*b*, which makes an additional support possible for the operator, for example when travelling around a bend. In a second, lateral operating position, the operator can actuate the steering wheel 20 arranged on the operator's console 14 with his left hand. In this operating position, the operator can grip the handle 22*b* of the driving actuation device 21*b* with his right hand and, in addition, actuate the driver switch 23*b* with the fingers of his right hand, which is gripping the handle 22*b*. In this lateral operating position, the extension 32*a* forms a lateral leaning aid 33*a* for the operator.

With reference to FIGS. 1 and 4, the battery compartment cover 16, or at least a portion of the battery compartment cover 16 (e.g., the portion having the leaning aid 31), can pivot around the pivot axis 17 from the vertical position (shown in FIG. 1) to a horizontal position to act as a seat upon which the driver can sit.

The lateral operating positions make it possible for the operator to have a good view of the roadway and to operate the fork-lift truck in an ergonomically favourable manner, in particular for driving of the fork-lift truck when the drive part 5 is at the front in the direction of travel, for example in order to transport a picked-up load over long sections within a warehouse.

Instead of the control device 15 formed from the driving actuation devices 21*a*, 21*b*, it is likewise possible for the control device 15 to have only one driving actuation device 21*a* or 21*b*, as a result of which the fork-lift truck according to the invention has a further lateral operating position for the operator standing on the driver's platform 11 in addition to an operating position in which the operator is viewing the direction of the load part and controls the fork-lift truck by means of the operator's console 14.

The invention claimed is:

1. A fork-lift truck, comprising:

a battery-electric drive system, a driver's stand having a driver's platform for a standing operator formed between a load part and a drive part having a counterweight, an operator's console, comprising a steering wheel and a driving actuation device, the operator's console being arranged on a region facing the load part, and a control device comprising at least one additional driving actuation device, wherein the counterweight is formed by a battery pack device having at least one battery pack and the battery pack device is arranged in a battery compartment formed in the drive part, wherein the battery compartment is covered by a battery compartment cover directly attached to the drive part, wherein the driver's stand extends over an entire vehicle width and the driver's platform is open to both sides of the truck to allow a driver to mount and dismount on both sides of the truck, wherein a leaning aid for an operator viewing in a direction of the load part is formed on the battery compartment cover, wherein the control device is arranged on the battery compartment cover on the drive part above the leaning aid and the at least one additional driving actuation device includes a handle non-movably attached to the battery compartment cover and a driving switch arranged on the handle, and wherein the operator's console and the control device are configured such that the driver may actuate the steering wheel and the at least one additional driving actuation device of the control device simultaneously.

2. The fork-lift truck according to claim 1, wherein the drive part has an equipment area, and the battery compartment is arranged above and/or adjacent to the equipment area of the drive part.

3. The fork-lift truck according to claim 2, wherein the battery compartment is arranged in a transverse direction of the fork-lift truck.

4. The fork-lift truck according to claim 1, including at least one lateral leaning aid for an operator standing to a side formed on the battery compartment cover.

5. The fork-lift truck according to claim 4, wherein the leaning aid is formed by a laterally arranged extension of the battery compartment cover which extends in a direction of the driver's stand.

6. The fork-lift truck according to claim 1, wherein the load part has a lifting frame and the operator's console is arranged on a parapet facing the lifting frame.

7. The fork-lift truck according to claim 1, wherein the operator's console is vertically displaceable.

8. The fork-lift truck according to claim 1, wherein the driving actuation device of the operator's console has a handle and a driving switch arranged on the handle.

9. The fork-lift truck according to claim 1, including an actuation device controlling a lifting drive selected, from a lifting and/or lowering switch, is arranged on the operator's console.

10. The fork-lift truck according to claim 1, including at least one actuation device controlling an additional drive arranged on the operator's console.

11. The fork-lift truck according to claim 1, including a signal transmitter for a signal device arranged on the operator's console.

12. The fork-lift truck according to claim 1, including an emergency-stop switch arranged on the operator's console.

13. The fork-lift truck according to claim 1, including a display instrument arranged on the operator's console.

14. The fork-lift truck according to claim 1, including a keyswitch arranged on the operator's console.

15. The fork-lift truck according to claim 1, including at least one signal transmitter for a signal device arranged on the control device.

16. The fork-lift truck according to claim 1, wherein the leaning aid is formed by dents in the battery compartment cover.

17. The fork-lift truck according to claim 1, wherein the operator's console is horizontally displaceable.

18. The fork-lift truck according to claim 1, wherein the operator's console is tiltable.

19. The fork-lift truck according to claim 1, wherein the battery pack is arranged on a rear end of the truck above a rear wheel of the truck.

* * * * *